United States Patent [19]

Laier

[11] Patent Number: 4,710,057

[45] Date of Patent: Dec. 1, 1987

[54] METHOD AND APPARATUS FOR BUILDING UP BEACHES AND PROTECTING SHORELINES

[76] Inventor: James E. Laier, 2620 Wagon Wheel Dr., Mobile, Ala. 36609

[21] Appl. No.: 915,186

[22] Filed: Oct. 3, 1986

[51] Int. Cl.[4] ..... E02B 3/04

[52] U.S. Cl. ..... 405/30; 405/24; 405/32

[58] Field of Search ..... 405/15, 21, 24, 25, 405/28, 32, 284, 30

[56] References Cited

U.S. PATENT DOCUMENTS

| | | | |
|---|---|---|---|
| 226,772 | 4/1880 | Mueller | 405/28 |
| 611,588 | 9/1898 | Brooks | 405/32 |
| 1,748,444 | 2/1930 | Dutton | 405/28 |
| 1,969,123 | 8/1934 | Doble | 405/28 |
| 2,655,790 | 10/1953 | Daley | 405/28 |
| 3,214,916 | 11/1965 | Martin | 405/28 |
| 3,564,853 | 2/1971 | Csiszar | 405/32 |
| 4,483,640 | 11/1984 | Berger et al. | 405/15 |
| 4,530,622 | 7/1985 | Mercer | 405/284 X |
| 4,534,675 | 8/1985 | Morrisroe | 405/24 |

*Primary Examiner*—David H. Corbin
*Attorney, Agent, or Firm*—Caesar, Rivise, Bernstein, Cohen & Pokotilow, Ltd.

[57] ABSTRACT

Apparatus and a method for protecting beaches and shorelands from erosion caused by wave action. The apparatus consists of a system of plural interconnected compartments disposed under the water on the seabed in an array which extends generally parallel to the shoreline of the beach. Each compartment is formed by plural flexible wall portions comprising an open mesh, buoyant material. The wall portions are anchored to the seabed so that they extend in a generally vertical orientation. Anchoring means are provided to enable the wall portions to move towards the beach with incoming waves while precluding those wall portions from moving backwards substantially beyond the vertical orientation with backwash waves, whereupon sand or other particulate material suspended in the water is enabled to drop out of suspension within the compartments during the backwash waves. The compartments are formed by two groups of wall sections, one group comprising plural webs extending parallel to one another and generally parallel to the direction of the principle waves over the seabed and another group being formed of plural webs extending across and intersecting the other webs. The webs are joined together at their intersections. The anchoring means comprise plural tension strips, each of which is connected to a respective one of the webs of the first group at a location adjacent the beachward side of the system.

18 Claims, 12 Drawing Figures

FIG. 1
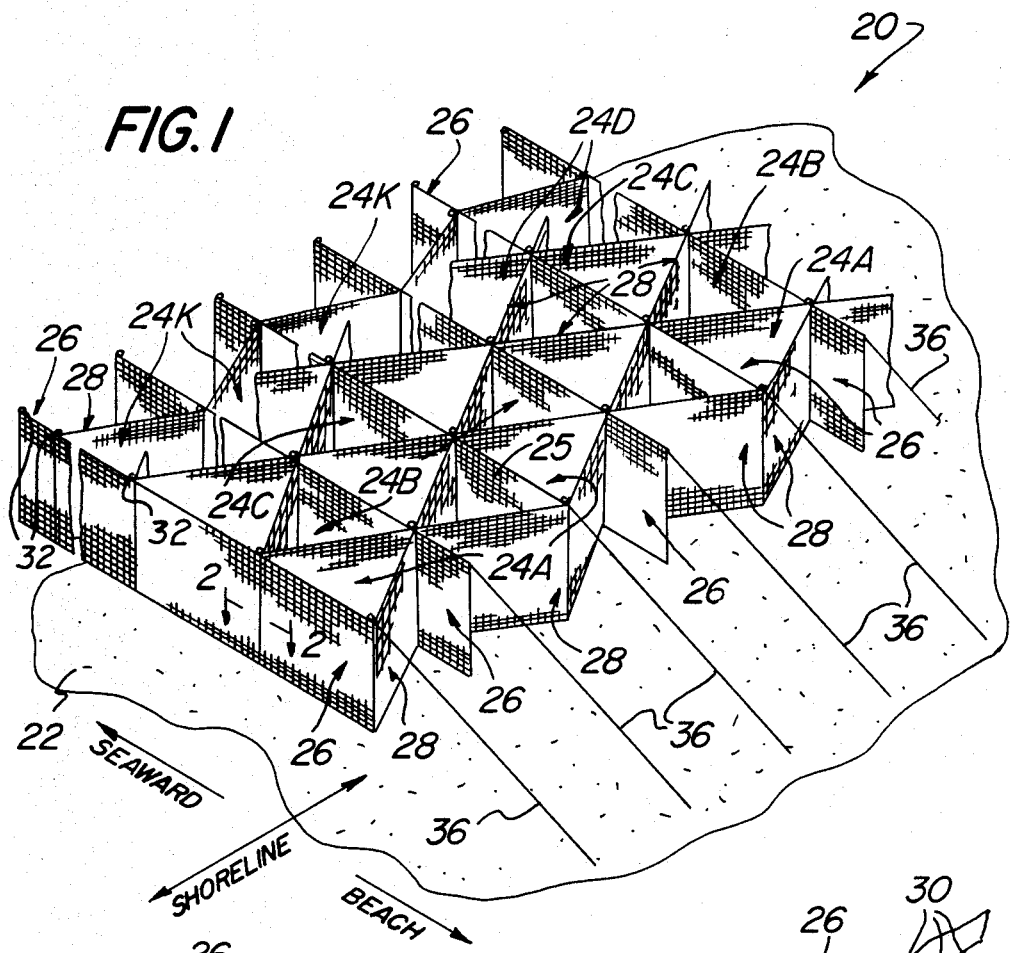
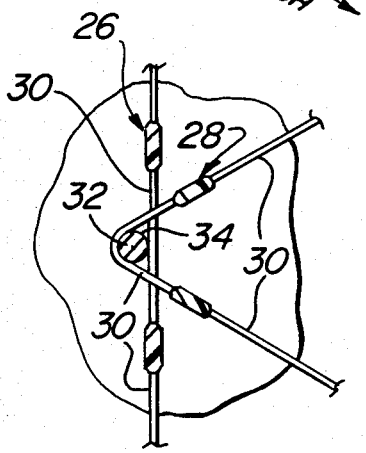
FIG. 2
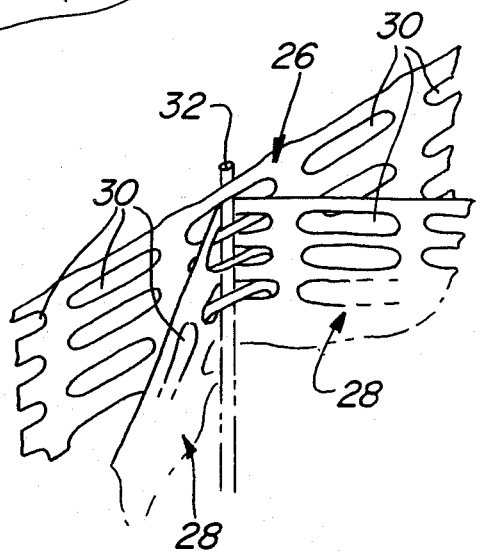
FIG. 3

FIG. 9
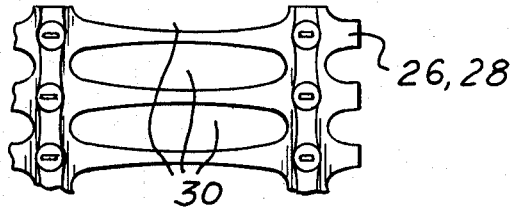
FIG. 10
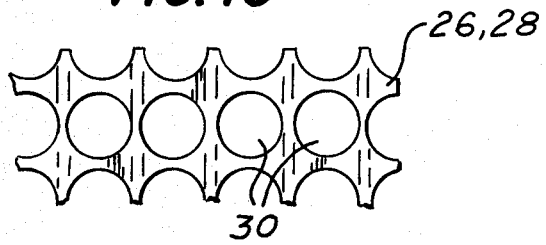
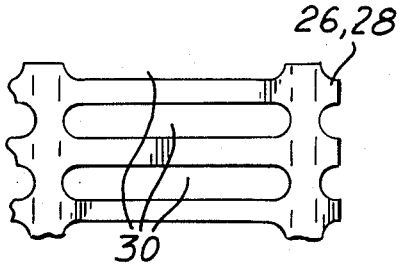
FIG. 11
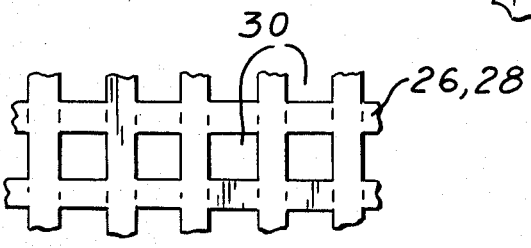
FIG. 12

METHOD AND APPARATUS FOR BUILDING UP BEACHES AND PROTECTING SHORELINES

BACKGROUND OF THE INVENTION

This invention relates generally to apparatus and a method for protecting beaches and shorelines and more particularly apparatus and a method for preventing erosion of beaches and shorelines by wave action and for building up such beaches and shorelines by sedimentation of water suspended particles.

As a result of coastal evolution, storm waves, and a general rise in sea level, shoreline recession has become a widespread phenomenon throughout the world. A common response to the dynamic waterfront erosion process normally involves implementing some type of shoreline stabilization process ranging from the simple planting of dune grass or other vegetation to the complex construction of large sea walls, offshore breakwaters, groins or jetties. Unfortunately, the construction costs inherent in stabilizing shorelines using such conventional techniques are high, while the benefits derived therefrom are often shortlived.

As will be appreciated by those skilled in the art, a beach or shoreland is one of nature's most dynamic environments, with a zone of active sand movement constantly changing and ever migrating in accordance with natural law. The dynamic equilibrium of all shoreline systems depends on wave size, sea level rise, beach sand supply, the shape of the beach, as well as the impact of human beings on the system. Beaches are created during periods of good weather and are eroded during storm tides.

Waves travel by pressure and move in an oscillating fashion somewhat similar to stalks of grain swaying in the wind. The forward and backward motions of the water, moving just above the bottom of the sea, are unsymmetrical, with the forward motion being stronger and of shorter duration than the backward motion. The carrying capacity for suspended solids in the moving water is generally proportional to the velocity of the flow. That velocity of flow can be regulated or influenced by environmental and/or man-made barriers. Thus, when the velocity of the flow is sufficiently reduced, deposition of suspended solid matter occurs.

The best protection against shoreline erosion is a wide beach since that environment causes the waves to break, thereby dissipating the wave energy before the erosion of the shoreline can occur. Normally, beaches grow seaward by deposition of sand from longshore currents and new sand brought from offshore by the formation of a ridge and runnel system perpendicular to the beach. Long waves of small amplitude serve to replenish the shoreline, while short storm waves of high amplitude erode the shoreline.

Experience has shown that natural sandbars provide excellent protection against destructive wave forces. Consequently, attempts have been made to simulate sandbar action by constructing artificial barriers parallel to the shoreline. Such barriers have been unsuccessful because high velocity water currents typically scour and undermine their foundations, causing the barriers to fail and to lose their effectiveness.

Some prior art patents have disclosed methods and/or apparatus for controlling the erosion of shoreline. Examples of such patents are U.S. Pat. Nos. 3,564,853 (Csiszar), 3,214,916 (Martin), 2,655,790 (Daley), 1,969,123 (Doble) and 226,772 (Meuller). While the systems of the foregoing patents may, to some extent, be effective for controlling erosion of shorelines or aiding in building up beaches, they nevertheless suffer from one or more of various drawbacks, such as complexity, cost, effectiveness and longevity.

OBJECTS OF THE INVENTION

Accordingly, it is a general object of the instant invention to provide a system and method which overcomes the disadvantages of the prior art.

It is a further object of the instant invention to provide an economical and effective means for producing sandbars for the formation and protection of beaches.

It is a further object of the instant invention to provide a system and method of stabilizing shorelines, beaches and controlling the erosion thereof through the use of a permanent structure which is easy to install and which is readily adaptable to varying water depths and longshore currents.

It is still another object of the invention to provide a method and system for producing sandbars for the formation and protection of beaches and which is internally reinforced to provide protection from loss of sand during storms.

SUMMARY OF THE INVENTION

These and other objects of the instant invention are achieved by providing a system for controlling erosion of the beach at a seabed through sedimentation of sand caused by wave action. The system comprises a plurality of interconnected compartments or cells disposed under the water on the seabed in an array extending generally parallel to the shoreline. The compartments are formed of plural wall sections. Each wall section is formed of an open mesh, buoyant material. The wall sections are anchored to the seabed by anchoring means so that they extend generally vertically. The anchoring means enable the wall sections to move toward the beach with incoming waves, while precluding them from moving backwards substantially beyond vertical orientation with backwash waves. This action ensures that sand suspended in the water is enabled to drop out of suspension within the compartments during the backwash waves.

DESCRIPTION OF THE DRAWING

Other objects and many of the attendant advantages of the subject invention will be readily appreciated as the same becomes better understood by reference to the following detailed description when considered in connection with the accompanying drawings wherein:

FIG. 1 is a perspective view of a system for controlling erosion constructed in accordance with the subject invention and shown anchored on a seabed;

FIG. 2 is a enlarged sectional view taken on line 2—2 of FIG. 1;

FIG. 3 is a enlarged perspective view of the portion of the system shown in FIG. 2;

FIG. 9 is an enlarged elevational view of the material making up the system shown in FIG. 1; and FIGS 10–12 are views similar to that of FIG. 9 but showing alternative materials for forming the system of FIG. 1.

DETAILED DESCRIPTION OF THE PREFERRED EMBODIMENT

Figure 4:
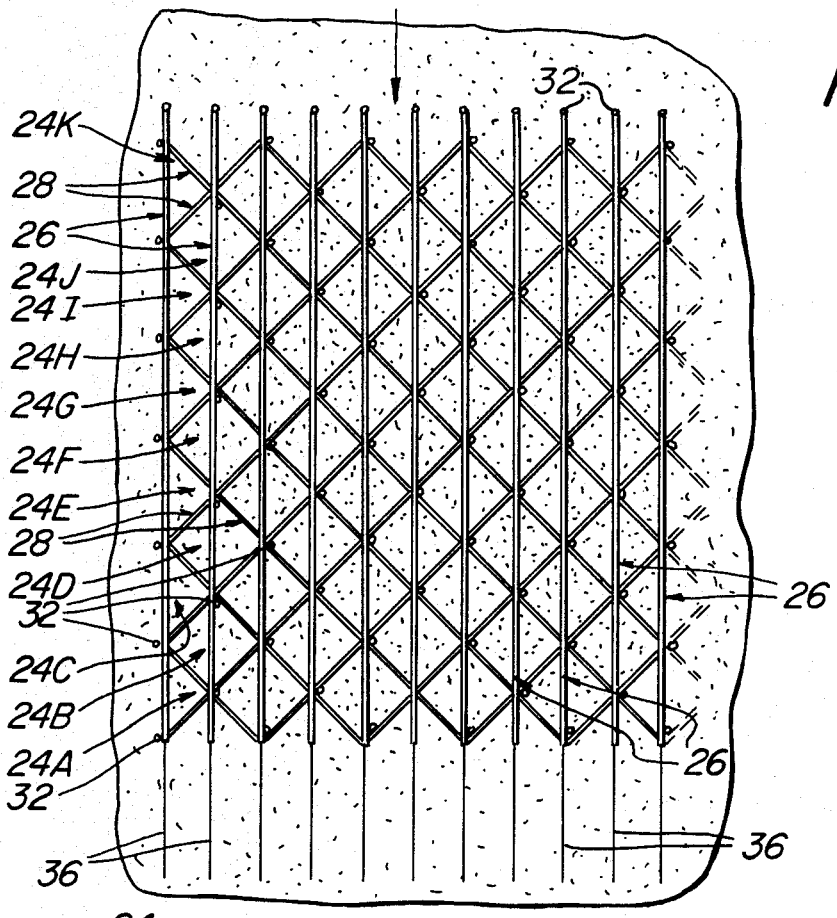
FIG. 4 is a plan view of the system shown in FIG. 1.

Referring now in greater detail to the various figures of the drawing wherein like reference characters refer to like parts, there is shown generally at 20 in FIG. 1 a system or apparatus constructed in accordance with the subject invention. The system 20 is arranged to be disposed and anchored on a seabed 22 adjacent a beach to be protected or formed.

As can be seen, the system 20 basically comprises a plurality of interconnected cells or compartments 24. The cells are, in the exemplary embodiment shown herein, triangular in shape and are arranged so that they extend in rows extending parallel to the shoreline. The rows are designated herein by successive letters. Thus, the system 20 comprises a first row of compartments or cells 24A extending generally parallel to the shoreline and closest to the beach and consecutively succeeding rows 24B to 24K. While the system 20 is shown with eleven rows of cells 24, it should be clear that it can have any number of parallel rows of cells 24 depending upon the application. In any event, the cells are formed by plural interconnected webs of an open aperture mesh material which will be described in considerable detail later.

As can be seen in FIGS. 1 and 4, the walls forming the compartments 24 are made up of two groups of web sections, one group of web sections comprises plural linearly disposed webs 26. These webs are referred to as "tension webs" and extend parallel to one another at equidistantly spaced locations and are aligned in the direction of the principal waves which pass over the seabed 22. This direction is shown by the two co-linear arrows bearing the terms "Seaward" and "Beach" in FIG. 1. A second group of web sections comprises plural serpentine webs 28. These webs are referred to as "diaphragm webs" and extend across and intersect in a serpentine manner the tension webs 26.

As stated earlier, each of the webs 26 and 28 is formed of an open mesh material as shown clearly in FIGS. 3 and 9. As can be seen therein, the material forming the webs includes a large number of apertures 30 therein. The apertures are preferably formed as elongated ovals whose principal axis extends parallel to the length of the web. The web sections 28 are connected or spliced to the web sections 26 at their points of intersection by means of respective anchor cords or rods 32. To that end, at each intersection or splice, the portions of the web 28 between a column of vertically aligned openings 30 at the line of intersection with the web 26 is folded somewhat and extended through the column of openings 30 in web 26 and a cord or rod element 32 is extended through the triangular spaced passageway 34 (FIG. 2) created therebetween. As will be appreciated, the joint shown in FIGS. 2 and 3 represents an outside joint, that is, the joint formed by either of the two outside tension webs 26. The joints formed by the serpentine webs 28 with interior tension webs 26 is effected in a similar manner except that the portions of one serpentine web 28 between its apertures 30 extends through the apertures 30 in the tension web 26 from one side thereof while the portions between the apertures 30 in the serpentine web on the opposite side of the tension web extend through the apertures 30 in the tension web from that other side, a cord or rod anchor 32 is then extended through the passageway created between the two serpentine webs 28 and interposed tension web 26.

The mesh material making up the wall sections 26 and 28 is flexible and buoyant. The cords 32 are also formed of a flexible, buoyant material. Accordingly, when the system 20 is anchored on the seabed, in a manner to be described hereinafter, the webs 26 and 28 forming the walls of all of the compartments 24 extend generally vertically. The anchoring of the system 20 to the seabed is effected via the heretofore identified cords 32. To that end, each of the cords 32 extends into the sand of the seabed for a sufficient distance to hold the system in place via soil friction and cohesion against the action of the waves until the system is completely filled with sand, as will be described later.

As can be seen in FIG. 1 and FIG. 4, each of the tension webs 26 is connected adjacent its beachward end to a respective tension element or strip 36. Each of the strips 36 basically comprises a flexible material, having one end fixedly connected to the tension strip 26 and the other end extending into the sand on the seabed toward the beach. The strips 36, like the cords or bars 32, are anchored into the sand on the seabed via soil friction and cohesion. If desired, other mechanical devices (not shown) can be utilized to anchor the strips 36 and the cords 32 to the seabed. In any event, the strips 36 are anchored to the seabed in such a manner so that they are generally taut when the wall sections forming the multi-compartment system 20 are vertical. No tension strips are utilized on the seaward ends of the tension webs 26.

In accordance with the preferred embodiment of this invention, the web 26 and 28 are made of a durable polyethylene or equivalent high strength material which is resistant to marine life and salt water corrosion. One particularly effective material is the material sold by the Densar Corporation of 1210 Citizens Parkway, Morrow, Ga. 30260, under the designation Snow Fence Model SF-X-04100 and SF-X-01030. The anchor strips 36 and the anchor cords or rods 32 are also formed of flexible buoyant material which is of high strength, resistant to marine life and salt water corrosion, such as polyethylene.

The webs are highly permeable, that is, the openings 30 form a significant portion of the total area of the web. In particular, in the embodiment shown in FIG. 9, they have a porosity of approximately 50%. The highly permeable nature of the webs allows water to pass through the mesh network of the system with relative ease in both directions, to permit sand to be deposited in zones of low flow velocity throughout the system.

Figure 7:
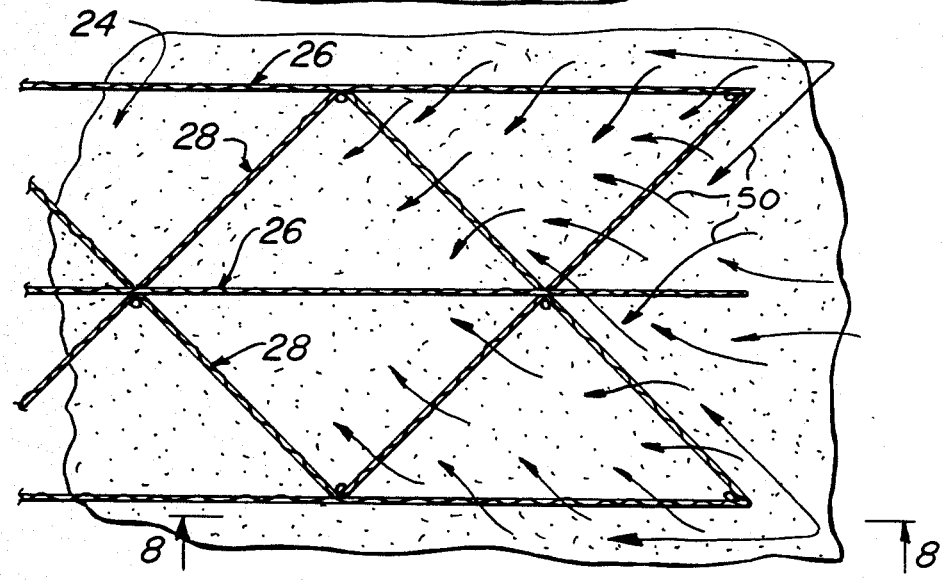
FIG. 7 is a plan view showing the action of the system to cause deposition of sand on the backwash waves.
Figure 6:
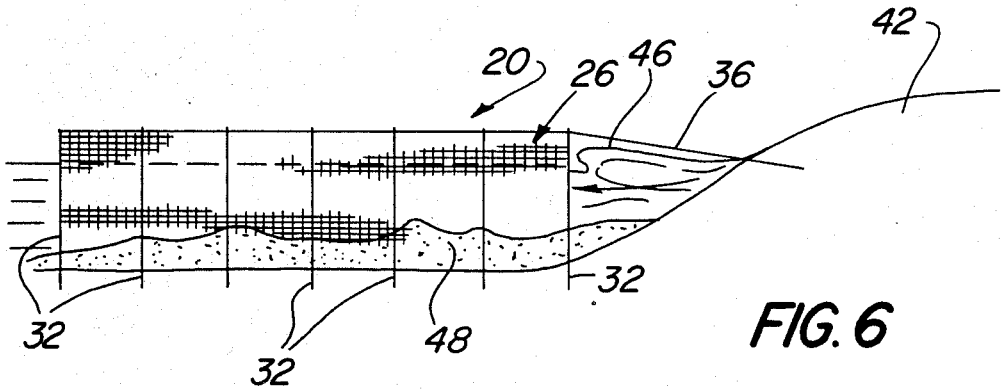
FIG. 6 is a side elevational view, similar to that of FIG. 5 but showing the restraint provided by the system against over-rotation caused by a backwash wave.
Figure 5:
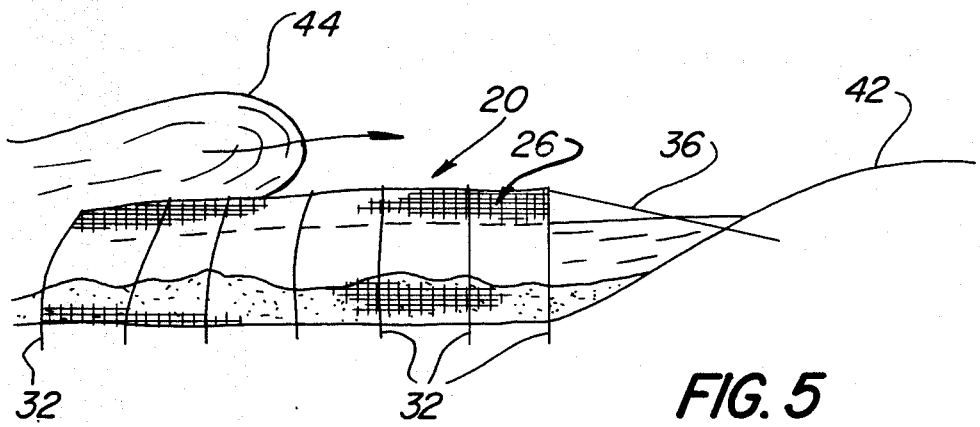
FIG. 5 is a side elevational view of the system of FIG. 1 shown deflecting toward the shore under pressure of an incoming wave.

Operation of the system 20 can best be understood by reference to FIGS. 5–7.

Figure 8:
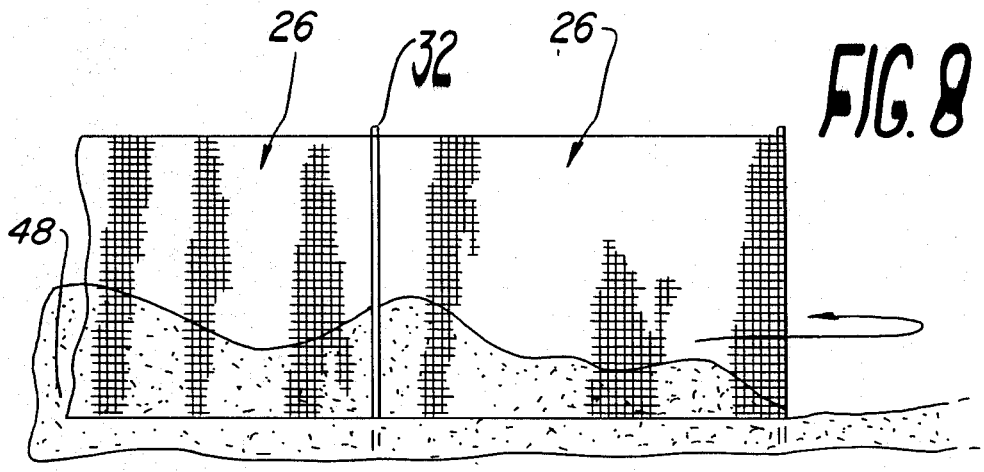
FIG. 8 is an elevational view taken along line 8—8 of FIG. 7.

Inasmuch as the mesh material forming the compartments 24 is flexible and since the tension strips 26 are not anchored under tension to the seaward side thereof, upon the occurrence of an incoming wave 44, like shown in FIG. 5, the mesh sections forming the compartments 24 pivot toward the beach 42 when incoming waves strike the serpentine web (diaphragm) sections 28. The rotation of the system 20 toward the beach with incoming waves is shown clearly in FIG. 5 and enables water to pass over the highly permeable system with relative ease. Upon the occurrence of the backwash wave 46, tension is applied by the strips 36 to prevent the backward rotation of the system 20 beyond the vertical orientation as shown in FIG. 6. In particular, as the backwash wave 46 applies pressure to the web system, the tension strips 36 which are secured along the beach tighten until the serpentine web diaphragm sections 28 are oriented vertically. This allows water to pass through the apertures in the permeable mesh network with relative ease but aids in enabling the suspended sand to drop out of suspension into the bottom 48 of the compartments 24. In particular, the forward and backward motion of the sea causes sand suspended in the water to be deposited within the network of compartments 24 due to the lowered velocity of the vortex formed within each compartment during the backwash wave, as illustrated in FIG. 7. Thus, as can be seen therein, the water from the backwash wave in carrying suspended sand flows through the plural apertures in the mesh forming the webs 26 and 28 (as shown by the arrows 50 in FIG. 7). The mesh thus lowers the velocity of the water so that the backwash wave's turbulent flow changes to a laminar flow within the cells due to a loss of energy and flow velocity. This action allows sand to drop out of suspension and to fall to the bottom of the cells (see FIG. 8). The build-up of sand in the cells continues, with the forward and backward motion of the sea causing the sand to be deposited within the network of cells. Gradually, the cells are completely filled with sand to form an internally reinforced sandbar. As the sandbar builds, the energy associated with the wave action progressively decreases and the errosional effects of the longshore and offshore currents are eliminated throughout the stabilized area. Because the sandbar is internally reinforced by the webs, it has both the strength to absorb wave energy as a breakwater and the structural integrity to hold back and protect the sandbar from being washed to a greater depth where it would not affect storm wave action or currents.

In order to select a site for the positioning of the system 20 of the subject invention, one should make a determination of the predominant wind direction, maximum velocity and duration, determine the direction, depth and width of the predominant longshore currents, study the mode of sand movement and secure a profile survey of the seabed area to be stabilized.

The beach recovery system 20 may be used for site reclamation, for the protection of maritime structures and for mining of minerals and is suitable for use in both freshwater and saltwater environments.

After the base network of the base has been filled with sand to form the stabilized barrier, subsequent mesh systems 20 may be installed to progressively stabilize larger adjacent and/or contiguous areas. Also, the recovery system 20 may be filled mechanically by dredging discharge or other means if it is desirable to shorten the fill-in time so that the beaches may be used for swimming, etc.

It should be pointed out at this juncture that the material forming the webs 26 and 28 may not be constructed of the specific material disclosed heretofore. Thus, the webs may be formed from any high strength, high density material, such as a synthetic plastic, nylon, fiberglas or other suitable material consisting of open work ribs uniformly spaced to form a continuous pattern of holes from top to bottom of the mesh. The geometry of the holes may be circular, rectangular, triangular or elliptical, with a cross-sectional area of the holes ranging from one square inch to twenty-five square inches, or more. In FIGS. 10–12, alternative meshes forming the webs 26 and 28 are shown.

In the preferred embodiment disclosed herein, the geometry of the holes, as noted earlier, is elliptical, and the size approximately four inches (10 cm) wide and 0.8 inches (2 cm) high. The number of elliptical holes per unit area is constant throught the network of the mesh. However, if desired, variations in geometry of the mesh could include offsetting apertures. Moreover, the diaphragm webs 28 when interconnected with the tension webs 26 need not form triangular compartments or cells 24, but can form other polygonal shapes, so long as they are able to pivot toward the beach with incoming waves and are prevented from pivoting beyond the vertical orientation with backwash waves.

As should be appreciated from the foregoing, the subject invention represents a practical and economical method for building and protecting beaches and other waterfront property by using compartmentalized flexible cells constructed of erosion resistant, mesh webs. These compartments or cells serve to capture and stabilize migrating sand along the shoreline areas where wave action and water currents normally tend to wash land away by erosion. In particular, the beach recovery protection system of the subject invention employs plural rows of flexible cells which run generally parallel to the shoreline. The cells or compartments are formed by flexible webs of open mesh buoyant material and designed to rotate or bend toward the beach when the force of an incoming wave strikes the system, thus avoiding the intense pressures of the incoming waves. Since the webs are highly permeable, they allow water to pass therethrough with relative ease in both directions, permitting sand to be deposited in zones of low flow velocity through the system during the backwash waves. Since the polyethylene mesh floats, it easily remains suspended at the required depth for optimum filling of sand. Once filled with sand, the webbed cells permanently reinforce the encapsulated sand, thereby creating a stabilized mattress capable of resisting erosion associated with normal wave action and currents and dynamic wave action during storms.

Without further elaboration, the foregoing will so fully illustrate my invention that others may, by applying current or future knowledge, readily adapt the same for use under various conditions of service.

I claim:

1. A system for controlling erosion of a beach at a seabed through sedimentation of sand caused by wave action, said system comprising a plurality of interconnected compartments disposed under the water on said seabed in an array extending generally parallel to the shoreline of said beach, said compartments being formed by plural flexible wall portions, each formed of an open mesh, buoyant material, said wall portions being anchored to said seabed in a generally vertical orientation by anchoring means, said anchoring means comprising means for holding said wall portions on said seabed, said wall portions flexing towards said beach with incoming waves, said anchoring means also comprising means for precluding said wall portions from flexing backwards substantially beyond said vertical orientation with backwash waves, the mesh of said wall portions decreasing the velocity of the water flowing therethrough on backwash waves, whereupon sand suspended in said water is enabled to drop out of suspension within said compartments during said backwash waves to settle therein and thus automatically fill said compartments.

2. The system of claim 1 wherein said array of compartments has a seaward side and a beachward side, and said anchoring means comprises at least one tension strip anchored to said seabed adjacent said beachward side to hold said wall portions in a substantially vertical orientation against the force of said backwash waves.

3. The system of claim 2 wherein said compartments are formed by two groups of wall sections, one group of wall sections comprising plural webs extending parallel to one another and generally parallel to the direction of the principle waves over said seabed, and another group being formed of plural webs extending across and intersecting the webs of said one group, the webs of both of said groups being joined together at their intersections by joint means.

4. The system of claim 3 wherein said anchoring means comprises plural tension strips, each of said strips being connected to a respective one of the webs of said first group adjacent the beachward side thereof.

5. The system of claim 3 wherein said joint means comprise flexible elongated members, each of said members extending generally vertically through a respective intersection in said webs.

6. The system of claim 5 wherein said flexible elongated members of said joint means are anchored to said seabed at their lower end.

7. The system of claim 3 wherein said webs of said other group are arranged in a serpentine fashion across the webs of said one group to form generally triangular shaped compartments.

8. The system of claim 7 wherein said anchoring means comprise plural tension strips each connected to a respective one of the webs of said first group adjacent the beachward side thereof.

9. The system of claim 8 wherein said flexible joint means comprise flexible elongated members, each of said members extending generally vertically through a respective intersection in said webs.

10. The system of claim 9 wherein said flexible elongated joint members are anchored to said seabed at their lower end.

11. The system of claim 3 wherein said webs are formed of a plastic material.

12. The system of claim 11 wherein said webs include plural elongated apertures therein, said apertures having a longitudinal axis extending generally parallel to the longitudinal direction of said web.

13. The system of claim 12 wherein said apertures are generally elliptical.

14. The system of claim 13 wherein the porosity of said webs is approximately fifty percent.

15. The system of claim 11 wherein said plastic material is high density polyethylene.

16. The system of claim 14 wherein said plastic material is high density polyethylene.

17. The system of claim 16 wherein said tension strips and elongated joint means are each formed of a plastic material.

18. A method for controlling erosion of a beach at a seabed through sedimentation of sand caused by wave action, said method comprising disposing an array of interconnected porous compartments under the water at said seabed so that said compartments are disposed generally parallel to the shoreline of said beach, said compartments being formed of flexible wall portions of an open mesh, buoyant material, anchoring said wall portions to said seabed by anchoring means to hold said compartments on said seabed yet enable said wall portions to flex towards said beach with incoming waves, said anchoring means comprising means precluding said portions from moving backwards substantially beyond a vertical orientation with backwash waves, said wall portions being highly permeable to the flow of water and suspended sand therethrough, whereupon said wall portions enable water to flow therethrough at a lower velocity during said backwash waves so that sand suspended therein is enabled to drop out of suspension within said compartments during said backwash waves to automatically fill said compartments with sand.

* * * * *